United States Patent [19]

Rosa

[11] 3,930,326

[45] Jan. 6, 1976

[54] DESK CALENDAR

[76] Inventor: Anthony G. Rosa, 216 Post Ave., Lyndhurst, N.J. 07071

[22] Filed: June 14, 1974

[21] Appl. No.: 479,375

[52] U.S. Cl. ..... 40/114; 40/77.4; 40/77.9

[51] Int. Cl.[2] ..... G09D 3/06

[58] Field of Search ..... 40/107, 111–113, 40/68, 68.4, 77.4, 77.6, 77.8, 77.9; 192/46, 48.92; 235/103; 116/115

[56] References Cited

UNITED STATES PATENTS

| | | | |
|---|---|---|---|
| 1,330,407 | 2/1920 | Svenson | 192/46 |
| 2,078,781 | 4/1937 | Sprenger et al. | 192/46 X |
| 2,110,668 | 3/1938 | Janssen | 40/111 |
| 3,333,356 | 8/1967 | Bosland | 40/114 |

*Primary Examiner*—John H. Wolff

*Attorney, Agent, or Firm*—Kirschstein, Kirschstein, Ottinger & Frank

[57] ABSTRACT

A desk calendar which permits the day, date and year to be changed by the simple manipulation of two dials, having, internally, a first and second shaft, each shaft controlling two rotatable drums. Each shaft has disposed thereon a first and second actuating member for operative engagement with a coupling device such that when the dialing member is turned in one direction the first drum will rotate and when the dial member is turned in the opposite direction the second drum will rotate. The same structure is related to the second shaft which is disposed on the other end of the frame having a separate dialing member associated therewith.

3 Claims, 4 Drawing Figures

DESK CALENDAR

BACKGROUND OF THE INVENTION

1. Field of the Invention.

The present invention relates to a calendar and more particularly to a calendar indicating the day, the date and the month of the year, for desk use.

2. Prior Art.

Heretofore, numerous calendars have been provided in the prior art which required a great deal of manipulation in order to change the date and the day of the month of the year in regard to the calendar. The desk calendar, although a convenience to the user, had been a nuisance to manipulate in order to keep the calendar up to date.

Prior art devices also required the holding of the base member while adjusting the calendar because when the dials were moved the entire unit, on the push-pull type, would move as a result of the manipulation.

The prior art devices further required the manipulation of numerous knobs or dials and required the pressing in and turning or the pulling out and turning of various knobs and dials to accomplish the necessary changes. The presence of these dials made the calendar rather unsightly and did not provide the convenience as originally intended with the beauty required for a person's desk.

SUMMARY OF THE INVENTION

It is the general object of the present invention to avoid and overcome the foregoing and other difficulties in the prior art devices by the provision of an inexpensive and easily manipulated desk calendar which is capable of adjusting with only one hand to provide the changes in day, date, and month.

Another object of the present invention is to provide a desk calendar which will permit the easy changing of the day, date and month of the year.

Yet another object of the present invention is to provide a desk calendar which will permit the turning of one dial to change the day and date and use of only a second dial to change the month and date.

A further object of the present invention is to provide an attractive desk calendar which is relatively small and will not take up excessive room on the top of the desk.

The objects of the present invention and other objects which will become apparent as the description proceeds are achieved by providing a desk calendar having a frame and provided with a plurality of windows in the frame, a first dial capable of rotation in two directions in communication with the frame, a second dial capable of rotating in two directions also in communication with the frame, a coupling disposed within the frame and extending therethrough to communicate on one end with the first dial and on the other end with the second dial, a coupling member mounted on each end of the shaft, an actuating member connected to the dial and capable of communicating with the coupling member for turning the shaft in one direction, a second actuating member mounted within the frame and on the shaft for turning the shaft in the opposite direction, and dials disposed on the shaft indicating the day, date and month of the year.

BRIEF DESCRIPTION OF THE DRAWINGS

For a better understanding of the present invention, reference should be had to the accompanying drawings wherein like numerals of reference indicate similar parts throughout the respective views and wherein.

BRIEF DESCRIPTION OF PREFERRED AND ALTERNATIVE EMBODIMENTS

Figure 1:
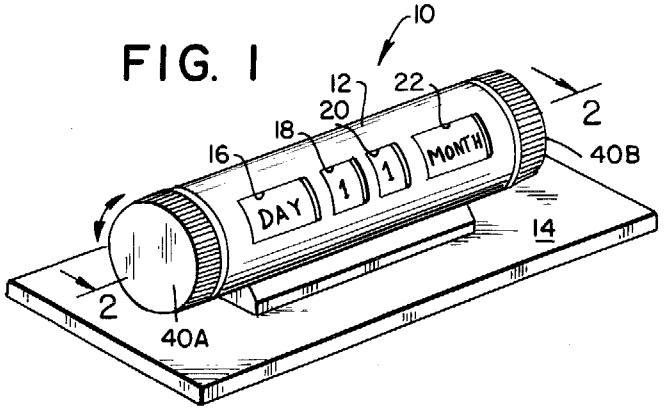
FIG. 1 is a perspective view of the desk calendar.
Figure 2:
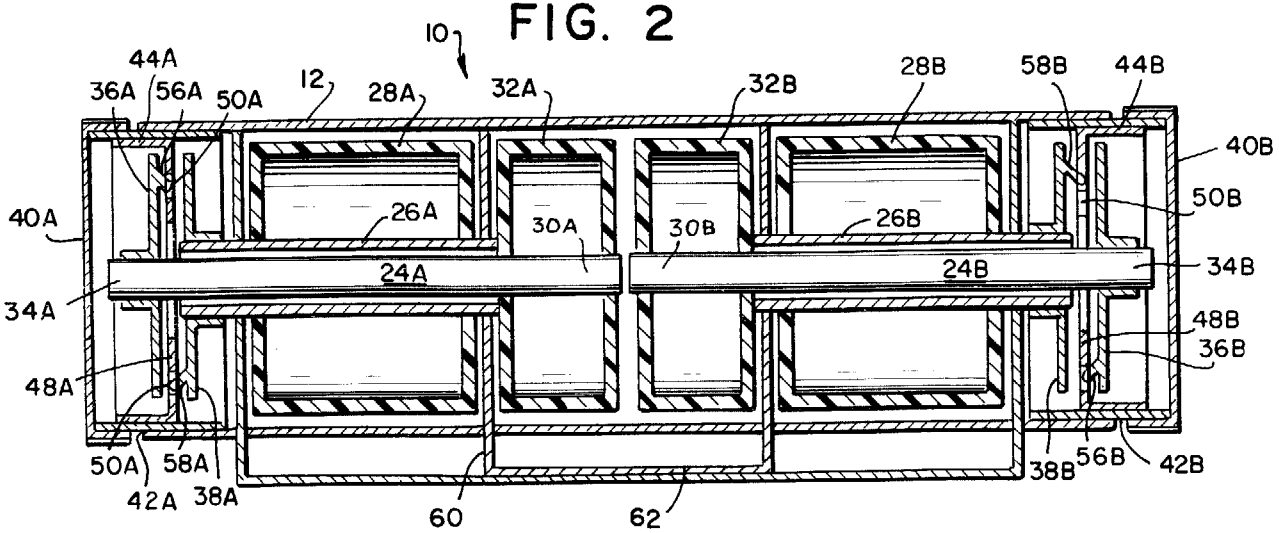
FIG. 2 is a cross sectional view of the desk calendar taken along lines 2—2 of FIG. 1.

Referring now to FIGS. 1 and 2, a desk calendar is shown and generally described and referred to by reference numeral 10. A frame 12 may be provided which is in a generally tubular shape and may be mounted on a base 14. The tubular frame 12 may be provided with four windows; the first window 16 is used for indicating the day of the week, the second window 18 and third window 20 for indicating the numerical date and the fourth window 22 for indicating the month of the year. Although four windows are shown, it may be seen that only three need be provided; the second and third windows may be combined into one and in this case only three windows would be used, the center window being used for indicating the entire numerical date.

As shown in FIG. 2, disposed within the frame 12, there may be provided a first shaft 24A and a second shaft 24B in axial alignment one with each other. The first shaft 24A may have provided therearound a first sleeve 26A which is fixedly connectable to a first drum 28A to be rotated when the sleeve 26A is rotated. The first drum 28A, indicating the day of the week, may be in registration with the first window 16 in the frame 12. To the end 30A of the first shaft 24A and in registration with the second window 18 there may be fixedly connected a second drum 32A which is rotatable within the frame means 12 and may be provided with numbers thereon one through three. On the end 30B of second shaft 24B there may be fixedly mounted a third drum 32B indicating thereon the numerical date which is in registration with the third window 20 in the frame means 12. A second sleeve 26B may be provided around the second shaft 24B, which second sleeve 26B may have fixedly connected thereto a rotatable drum 28B which provides an indication of the month of the year and which would be in registration with the fourth window 22.

It should be noted that regarding the elements hereinabove and hereinafter described, used in conjunction with the first shaft 24A, their mirror images are used in cooperation with the second shaft 24B so that the movement and general operation of the two shafts are identical, as well as their cooperation with the elements used in conjunction therewith. To this end, the suffix A is related to the reference numeral used in cooperation with the first shaft 24A, and the suffix B is used in connection with the elements used on the second shaft 24B.

At the other extremity 34A of the first shaft 24A, a first actuating member 36A may be fixedly mounted thereon and in spaced relationship therewith a second actuating member 38A may be mounted on the first sleeve 26A which fits over and around the first shaft 24A. Similarly, on the outer extremity 34B of the second shaft 24B a third 36B and fourth actuating member 38B are provided which are mirror images of the previously described first 36A and second 38A actuating member, and are respectively connected to the second shaft 24B and second sleeve 26B in the same member.

Figure 3:
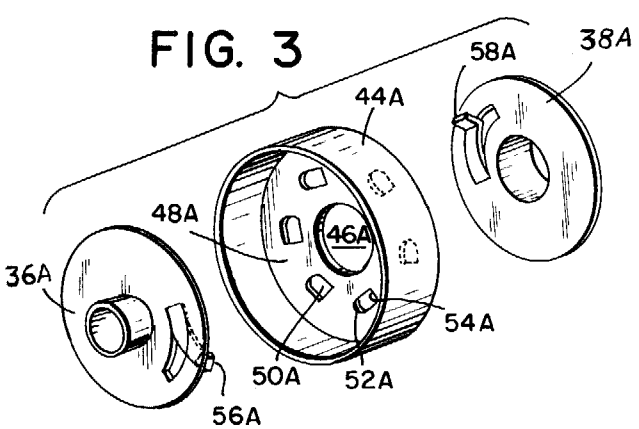
FIG. 3 is an exploded assembly view of the actuating members and the coupling means.

Dialing members 40A and 40B are provided at the outer extremities of the frame 12. The frame 12 is provided with open ends 42A and 42B to accommodate the dialing members 40A and 40B which are insertable in the open ends 42A and 42B respectively. The dial member 40A is adapted to rotate in either the forward or rearward direction, as shown by the arrow in FIG. 1, and has connected thereto a coupling device 44A shown in FIG. 3. Structurally, the coupling device 44A takes the shape of a cup-like arrangement having a cylindrical wall and an aperture 46A in the bottom wall 48A thereof which is adapted to fit over the first shaft 24A so that the shaft 24A is freely rotatable in the aperture 46A. The coupling device 44A is provided with a bottom wall 48A which may have a plurality of holes therein 50A. Each of the holes 50A is in the form of a horseshoe arrangement and having the rounded portion 52A of the horseshoe-shaped hole 50A facing in opposite directions as shown in FIG. 3.

FIG. 2 illustrates generally the disposition of the holes 50A as being alternately positioned such that the straight edges 54A of the horseshoe-shaped holes 50A are presented to a protuberance 56A extending laterally from the first actuating member 36A and a second protuberance 58A extending from the second actuating member 38A. Operationally, when the dialing knob is moved in the forward direction (shown in FIG. 1) the protuberance 56A extending from the first actuating member 36A will mate with the straight edge portion 54A to rotate the first shaft 24A whereas the shape of the protuberance 58A extending laterally from the actuating member 38A will pass over the rounded portion 52A of the holes 50A much the same as a ratchet arrangement.

When the dialing member 40A is rotated in the rearward or counter-clockwise direction, the protuberance 58A of the first actuating member 36A will slide over the holes 50A while the protuberance 58A of the second actuating member 38A will mate with the straight edge portion 54A of the holes 50A to rotate the first sleeve member 26A.

In a similar manner, the second shaft 24B and sleeve 26B are turned by manipulation of the second dialing member 40B at the other end of the frame 12.

It may be seen, therefore, that when rotating the dial member 40A or 40B at one end of the frame in one direction, the day of the month may be changed as it appears in the first window 16; when the same dial 40A is rotated in the opposite direction the day will remain stationary while the date (numerical) will be changed in the second window 18. Similarly, when the dial member 40B on the other end of the frame 12 is rotated, the date (numerical) may be changed in the third window 20, and when rotating the dial member 40B in the opposite direction, the month of the year changes in the fourth window 22 while the date remains fixed. Here, therefore, by the simple manipulation of two dialing members 40A and 40B the day, date and month may be changed and adjusted to appear in the four windows provided in the frame 12.

It may be seen that only three windows may be used without departing from the essence of the invention. This may be accomplished by combining windows two 18 and three 20 into one large window which would adequately show the two numbers on the drums two 32A and three 32B.

As shown in FIG. 2, a support bracket 60, which may be of unitary construction, is disposed within the frame means 12 to rotatably support the first and second sleeves 26A and 26B, respectively. The lower portion 62 of the support bracket 60 may extend below the frame 12 for connection to the base 14.

Figure 4:
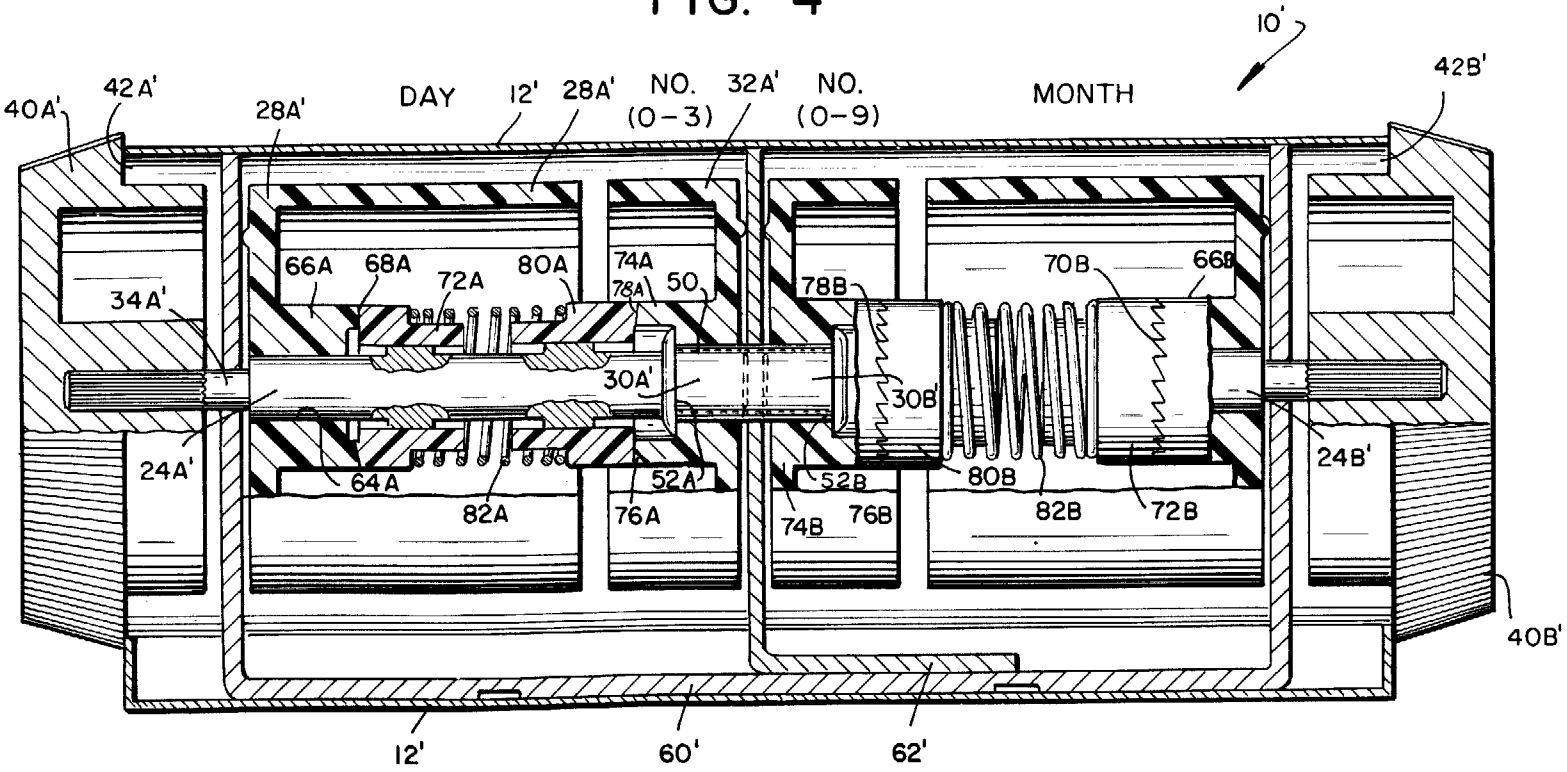
FIG. 4 is a cross sectional view of an alternative embodiment.

Alternatively, as shown in FIG. 4, a desk calendar of generally similar construction may be provided. Structurally, the desk calendar 10' may be provided with a frame 12' having shaft supporting brackets 60' and 62' connected within the frame 12'. The shaft supporting brackets 60' and 62' may be of generally unitary construction. The shaft supporting bracket 62' has an annular support 50 extending therethrough. The first shaft 24A' and second shaft 24B' are rotatably supported by the shaft supporting bracket 60' and the annular support 50 which receives ends 30A' and 30B' of shafts 24A' and 24B', respectively. The shafts are in axial alignment with each other.

A first drum 38A' may be mounted on one end 34A' of the first shaft 24A'. A second drum 32A' is mounted at the other extremity 30A' of the first shaft 24A' on the annular support 50. A retaining ridge 52A retains the second drum 32A' on the annular support 50. The first drum 38A' may be in alignment with the first window 16' so that the day of the week printed thereon may show through that first window 16'. Similarly, the second drum 32A' is mounted in the same respect with the second window 18' in the frame 12' by retaining ridge 52B.

Structurally, the first drum 28A' is provided with an aperture 64A in the center thereof and having a projection therearound 66A. The ends 68A of the projection 66A may be provided with ratchet teeth 70A (shown at 70B) which are adapted to mate with a ratchet element 72A fixedly mounted on the first shaft 24A' in contiguous relationship to the projection 66A of the first drum 28A'. Similarly, as shown in FIG. 4 the second drum 32A' may be provided with a projection 74A extending toward the first drum 28A' along the first shaft 24A'. At the end 76A of the projection 74A there may be provided ratchet teeth 78A pitched in the opposite direction to the ratchet teeth 70A on the projection 66A in the first drum 28A'. Adjacent the projection 74A on the second drum 32A there may be provided another ratchet element 80A adapted to mate with the teeth 78A on the end 76A of the projection 74A. A spring 82A may be provided which urges each ratchet element toward their respective mating positions with their projections, as shown in FIG. 4.

A dialing knob or dialing member 40A' is disposed in the open end 42A' of the frame 12'. Similarly, a dialing knob or dialing member 40B' is disposed in the open end 42B' of the frame 12'. The dialing member 40A' is fixedly connected to the end 34A' of the first shaft 24A' and similarly the dialing member 40B' is connected to the second shaft 24B'.

Referring now to the operation of the first shaft 24A', which operation is mirror imaged by the second shaft 24B', if it is desired to change the day of the week (first window 16') the dialing member 40A' may be turned in the direction of the arrow. When the dialing member 40A' is so turned, the first shaft 24A' turns therewith and in the same direction moving the ratchet elements in the same direction. Since the first and second drums 28A' and 32A' are not fixedly connected to the first shaft 24A', they will only move when the teeth of the respective projections 66A and 74A mate properly with the teeth on the ratchet elements 72A and 80A. When the dialing member 40A' is turned in the direction of the arrow the first drum 28A' will turn. However, the second drum 32A' will not turn because there is no proper mating of the ratchet teeth and the teeth on the projection. In this latter case the teeth will slide over each other and the drum 32A' will not turn. Conversely, when the dialing member 40A' is turned in the opposite direction, the teeth on the projection of the second drum 32A' will mate with the ratchet element contiguously mounted on the first shaft 24A' and the second drum 32A' will turn thereby changing the numerical date in the second window 18' or the combined second and third windows. Similarly, the elements mounted on the second shaft 24B' operate as a mirror image of the working elements associated with the first shaft 24A'.

Viewing both the preferred and alternative embodiments it will be recognized by those skilled in the art that a desk calendar is provided which permits the manipulation of merely two dialing members which will more readily change the day, date and month, and display the information in a well-coordinated and designed frame means.

While, in accordance with the patent statute, a preferred and alternative embodiments have been shown and described in detail, it is particularly understood that the invention is not limited thereto or thereby.

I claim:

1. A desk calendar comprising:

a. a frame means;

b. a shaft supporting means disposed within said frame means;

c. a first shaft rotatably supported by said supporting means;

d. a first sleeve in operable communication with said first shaft;

e. a first drum fixed to said first sleeve and bearing discrete day of the week indicia on its periphery;

f. a second drum in operable communication with said first shaft and bearing discrete integers in seriatim on its periphery;

g. a second shaft rotatably supported by said shaft supporting means, in axial alignment with said first shaft;

h. a second sleeve in operable communication with said second shaft;

i. a third drum fixed to said second shaft and bearing discrete integers in seriatim on its periphery;

j. a fourth drum in operable communication with said second sleeve and bearing discrete month of the year indicia on its periphery;

k. a plurality of windows in said frame means for denoting the day, date, and month each of said drums being in alignment with a separate one of said plurality of windows;

l. a pair of dialing members attached to said frame means and limited to rotational movement therein, one of said dialing members in communication with said first shaft and the other of said dialing members in communication with said second shaft for independently operating said first and second shafts, respectively; and m. a pair of actuating means limited to rotational motion, one of said actuating means in communication with said first shaft to permit the rotation of said first drum when said dialing member is rotated in one direction with said second drum remaining stationary and causing the rotation of said second drum when said dialing member is rotated in the opposite direction with said first drum remaining stationary, said other actuating means in communication with said second shaft to permit the rotation of said third drum when said dialing member is rotated in one direction with said fourth drum remaining stationary and causing the rotation of said fourth drum when said dialing member is rotated in the opposite direction with said third drum remaining stationary.

2. A desk calendar in accordance with claim 1 wherein said actuating means comprises:

a. a first actuating member fixedly mounted to said shaft provided with at least one lateral protuberance extending toward said first drum;

b. a second actuating member fixedly mounted to said first sleeve provided with at least one lateral protuberance extending away from said first drum;

c. A first coupling member disposed on the first shaft intermediate said first and second actuating members being connected to one of said dialing members and adapted to releasably engage said lateral protuberance from said first actuating member when said dialing member is turned in one direction without engaging said lateral protuberance from said second actuating member so that said first drum will rotate while said second drum remains stationary, and to releasably engage said lateral protuberance from said second actuating member when said dialing member is turned in the opposite direction without engaging said lateral protuberance from said first actuating member so that said second drum will rotate while said first drum remains stationary;

d. a third actuating member fixedly mounted to said second shaft provided with at least one lateral protuberance extending toward said first drum;

e. a fourth actuating member fixedly mounted to said second sleeve provided with at least one lateral protuberance extending away from said third drum; and f. a second coupling member disposed on said second shaft intermediate said third and fourth actuating members being connected to said dialing member and adapted to releasably engage said lateral protuberance from said third actuating member when said second dialing member is turned in one direction, without engaging said lateral protuberance from said fourth actuating member so that said third drum will rotate while said fourth drum remains stationary, and to releasably engage said lateral protuberance from said fourth actuating member when said dialing member is turned in the opposite direction so that said fourth drum will rotate while said third drum remains stationary.

3. A desk calendar in accordance with claim 2 wherein said first coupling member comprises a cylindrical wall attached to said first dialing member, a bottom wall integrally formed with said cylindrical wall, said bottom wall being provided with an aperture to allow said first shaft to pass through said bottom wall and a plurality of horseshoe-shaped holes, each of said holes having a rounded portion and a straight portion, each of said holes facing in opposite directions on said bottom wall, so that when said dialing member is rotated in one direction said protuberance from said first actuating member will mate with said straight edge of said horseshoe-shaped hole to rotate said first shaft, while said protuberance from said second actuating member will pass over said rounded portion of said holes and said second drum will remain motionless, and when said dialing member is rotated in the opposite direction, said protuberance from said second actuating member will mate with said straight edge of said oppositely facing horseshoe-shaped holes to rotate said second drum, while said protuberance from said first actuating member will pass over said rounded portion of said holes and said first drum will remain motionless, and said second coupling member comprises a cylindrical wall attached to said second dialing member, a bottom wall integrally formed with said cylindrical wall, said bottom wall being provided with an aperture to allow said second shaft to pass through said bottom wall, and a plurality of horseshoe-shaped holes, each of said holes having a rounded portion and a straight portion, each of said holes facing in opposite directions on said bottom wall, so that when said dialing member is rotated in one direction said protuberance from said third actuating member will mate with said straight edge of said horseshoe-shaped hole to rotate said second shaft, while said protuberance from said fourth actuating member will pass over said rounded portion of said holes and said fourth drum will remain motionless, and when said dialing member is rotated in the opposite direction, said protuberance from said fourth actuating member will mate with said straight edge of said oppositely facing horseshoe-shaped holes to rotate said fourth drum, while said protuberance from said third actuating member will pass over said rounded portion of said holes and said third drum will remain motionless.

* * * * *